US005774925A

United States Patent [19]

Pryor, III

[11] Patent Number: 5,774,925

[45] Date of Patent: Jul. 7, 1998

[54] ORAL WASH BRUSH

[76] Inventor: J. R. Pryor, III, 540 Florida Ave., Aurora, Ill. 60506

[21] Appl. No.: 676,701

[22] Filed: Jul. 10, 1996

[51] Int. Cl.[6] ..... A46B 9/04; A61H 13/00

[52] U.S. Cl. ..... 15/244.1

[58] Field of Search ..... 15/104.94, 110, 15/167.1, 244.1, 244.2; 433/142, 216; 601/136, 137, 138, 139, 141

[56] References Cited

U.S. PATENT DOCUMENTS

| | | | |
|---|---|---|---|
| 92,298 | 7/1869 | Francis | 15/244.1 |
| 938,421 | 10/1909 | Hakins | 15/244.1 |
| 1,924,337 | 8/1933 | Troupa | 15/244.1 |
| 2,611,147 | 9/1952 | Kampouris | 15/244.1 |
| 2,753,582 | 7/1956 | Fredericks | 15/244.1 |
| 3,389,418 | 6/1968 | Sencabaugh | 601/137 |
| 4,083,078 | 4/1978 | Shimizu | 15/244.1 |
| 4,128,910 | 12/1978 | Nakata | 15/110 |
| 4,299,208 | 11/1981 | Blanc | 601/141 |
| 4,331,422 | 5/1982 | Heyman . | |
| 4,455,704 | 6/1984 | Williams . | |
| 4,628,564 | 12/1986 | Youssef | 15/110 |
| 4,672,953 | 6/1987 | DiVito . | |
| 5,003,660 | 4/1991 | Oohinata | 15/244.1 |
| 5,463,792 | 11/1995 | Hogan et al. . | |

FOREIGN PATENT DOCUMENTS

| | | | |
|---|---|---|---|
| 3529953 | 3/1987 | Germany | 15/104.94 |

*Primary Examiner*—Randall Chin

*Attorney, Agent, or Firm*—Bullwinkel Partners, Ltd.; Robert W. Gustafson

[57] ABSTRACT

An oral hygiene device that allows elimination of bad breath through a thorough cleaning of the entire mouth with friction, including the tongue, teeth, gums, lips, cheeks, area under the tongue, and the area between the gums and the cheeks. The device comprises a sterile sponge mounted upon a rigid handle, and may replace or enhance the conventional toothbrush.

1 Claim, 2 Drawing Sheets

ORAL WASH BRUSH

BACKGROUND

1. Field of the Invention

This patent relates to implements used in the practice of oral hygiene and more particularly to an apparatus used for cleaning the entire mouth beyond the use of a normal toothbrush. This invention is intended to complement the use of a toothbrush in the daily routine of oral hygiene, and not to replace it.

2. Description of the Related Art

The practice of oral hygiene is a fixture of the public's daily routine. Most people are aware of the potential for bad breath and how it may effect their daily lives. The leading cause of bad breath is improper brushing and flossing for the teeth and washing of the mouth. People commonly complement their daily brushing routine through the use of mouth wash and the like, but these products are more correctly termed mouth "rinses," as they do little more than rinse the mouth, teeth, and gums and are more likely to mask odors than to remove them.

Products such as breath mints and sprays are similar to mouth rinse in that they attempt to cover or mask bad breath, but do not wash the mouth. In order to eliminate the cause of bad breath, it is necessary to eliminate the source of the odor. Some mouth rinses attempt to eliminate the source through removal of the bacteria that cause bad breath, but still only rinse the surface of the mouth and do not actually "wash" it.

The current invention, the oral wash brush provides a means to clean the entire mouth, preferably with the use of an anti-septic mouth rinse. The oral wash brush uses a soft sponge, preferably sterile affixed to a handle. The handle is usually rigid and made of plastic.

To clean teeth, people use a toothbrush and scrub the teeth. There are many patents for devices used to clean the teeth, such as the Copelan device, U.S. Pat. No. 5,445,825, disclosing a tooth brush where the mouth furnishes the only liquid necessary for the process. The Saxer device, U.S. Pat. No. 5,337,436, demonstrates a tooth cleaning device using fabric for friction instead of the traditional bristle brush.

There are many inventions made for more thorough cleaning of the teeth, such as the Simonds device, U.S. Patent No. 5,511,277. This device discloses a toothbrush where the handle includes angles and the head attaches to the handle with a hinge so that the individual may clean teeth from many angles. The Perkins device, U.S. Pat. No. 5,502,863 discloses a finger mounted tooth brush with a cleaning surface of fibrous plant material, or loofah.

These devices are typical of prior art. Many inventions provide the means to clean the teeth and gums more thoroughly, but very few are useful in cleaning the entire mouth. None of the previous inventions wash the mouth with the thoroughness of the oral wash brush, and therefore, none of them fight bad breath as well as the oral wash brush.

Therefore, it is a main objective of this invention to provide a device that cleans the entire mouth, including the teeth, gums, tongue, under the tongue, roof of the mouth, and inside lips and cheeks of the mouth thoroughly with friction.

It is another main objective of the invention to provide a device that removes the causes of bad breath through superior cleaning ability to products currently available.

Yet another main objective of the invention is to provide a supplement to a daily tooth brushing routine that greatly increases oral hygiene.

SUMMARY OF THE INVENTION

The present invention is designed to thoroughly clean the entire mouth instead of just the teeth and gums. The oral wash brush will succeed where other inventions fail because it scrubs the entire mouth clean through the use of friction as opposed to a simple rinse such as mouth wash or a toothbrush and the like which clean only part of the mouth.

In the preferred embodiment, the invention comprises a rigid handle and a sterile sponge head. The rigid handle is usually made of plastic, although wood or other similar rigid materials may be used. A preferred embodiment of the rigid handle includes a hand-hold portion, a first angled portion, a second angled portion, a sponge attachment portion, and may contain several substantially cylindrical holes located in the sponge attachment portion. Another embodiment comprises only a first angled portion, but not a second angled portion. In the preferred embodiment, the combination of the first and second angled portions lowers the center of the sponge attachment portion below the center of the hand-hold portion while leaving the two portions parallel. In the second embodiment, the first angled portion leaves the sterile sponge at an angle to the hand-hold portion. Each of these designs forms an angled handle that aids in scrubbing difficult to reach parts of the mouth.

In another embodiment of the invention, the sponge attachment portion may or may not contain three substantially cylindrical holes. The sterile sponge is molded to fit around the sponge attachment portion snugly. A sterile adhesive is applied to the sponge attachment portion and the sponge attachment portion is inserted into the sterile sponge. If the handle does contain several substantially cylindrical holes, the adhesive fills the several substantially cylindrical holes, forming several columns of adhesive to resist lateral pressure during use. The sterile adhesive also bonds the sterile sponge directly to the sponge attachment portion. If the sponge attachment portion does not contain several substantially cylindrical holes, the sterile adhesive bonds the sponge directly to the sponge attachment portion.

In yet another embodiment of the invention, the sterile sponge is removable, allowing disposal of the sponge after its useful life without the necessity of disposing of the whole invention. In this preferred embodiment, the handle will end in a handle mounting portion that is inserted into a sponge mounting portion. The handle mounting portion comprises a larger end and a smaller end. The larger end has a larger diameter than the smaller end, so that the handle mounting portion narrows from the larger end to the smaller end. The sterile sponge is mounted to the sponge mounting portion by any of the means outlined in this specification. The inside diameter of the sponge mounting portion is slightly larger than the smaller end of the handle mounting portion, but slightly smaller then the large end of the handle mounting portion. When the handle mounting portion is inserted into the sponge mounting portion, the two portions are held together by friction.

In another embodiment of the invention, the sterile sponge is removable, requiring several substantially cylindrical holes in the sponge attachment portion. In this preferred embodiment, the sponge is formed around a sterile attachment sleeve. The sterile attachment sleeve includes several angled extrusions to mate with the several substantially cylindrical holes in the sponge attachment portion. The angled extrusions allow movement of the sterile sponge linearly towards the hand hold portion of the handle. Once the sponge attachment is properly inserted into the sponge attachment sleeve, the angled extrusions enter the several substantially cylindrical holes. The angled extrusions prevent the sterile sponge and attachment sleeve apparatus from moving linearly along the sponge attachment portion in a direction away from the hand hold portion without the use of a substantial amount of force. To replace the sterile sponge, a substantial amount of force is applied to the sterile sponge and the sterile sponge sleeve, removing the used sterile sponge. After discarding the old sterile sponge, the sponge attachment portion is inserted into a new sterile sponge bonded to a sterile sponge sleeve.

THE DRAWINGS

DETAILED DESCRIPTION OF THE INVENTION

Figure 1:
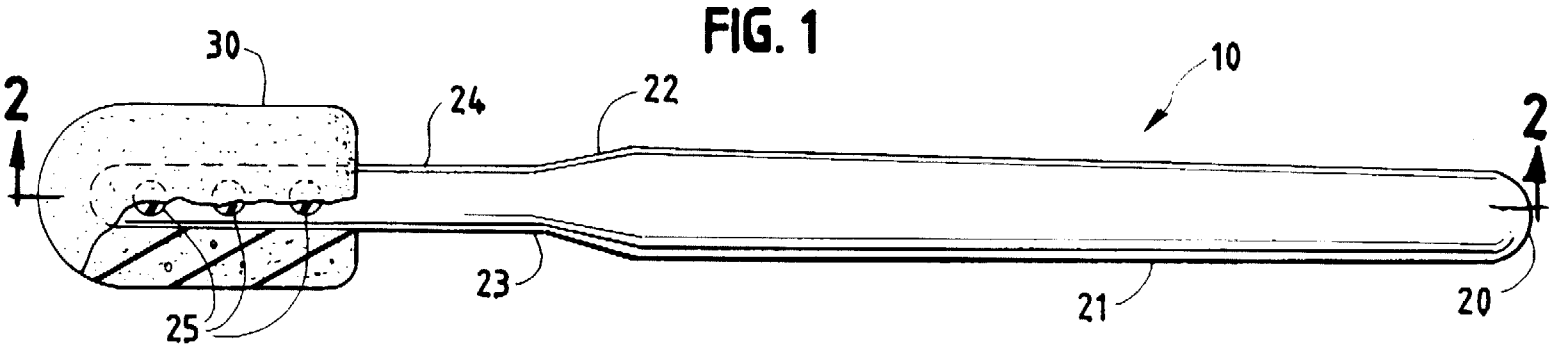
FIG. 1 is a view of one embodiment of the oral wash brush with a cut away view of the sterile sponge.
Figure 2:
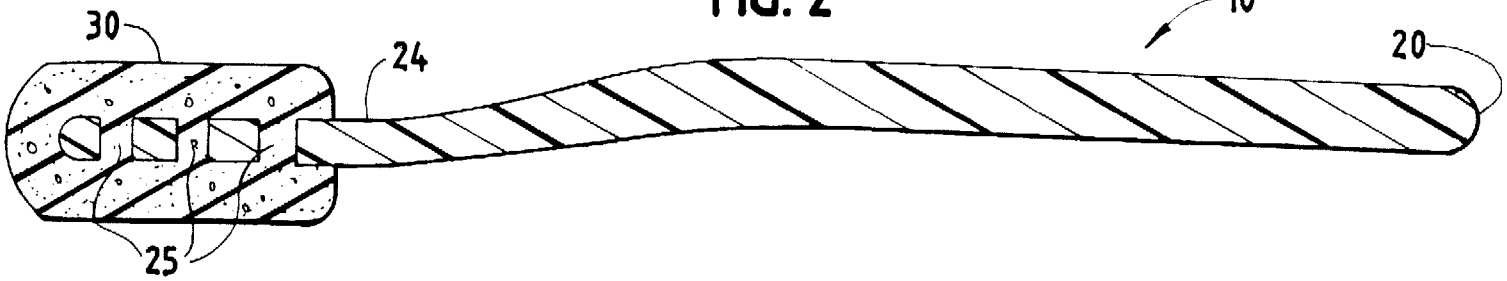
FIG. 2 is a cross-portional view of the oral wash brush of FIG. 1, taken along line 2—2.
Figures 4, 5, 6:
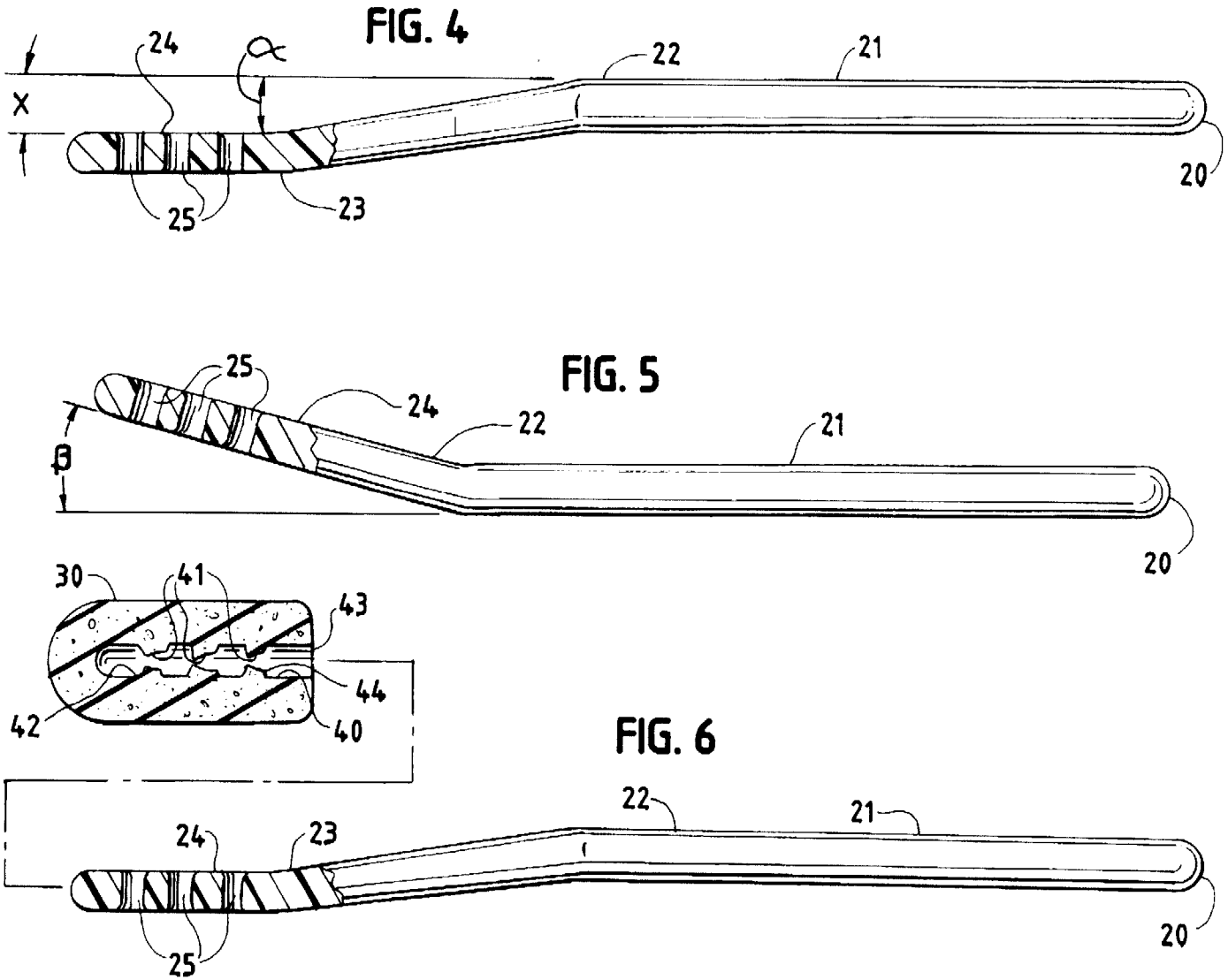
FIG. 4 is a side view of the handle of FIG. 1.
FIG. 5 is a side view of another embodiment of the present invention.
FIG. 6 is another embodiment of the oral wash brush, showing a detachable sponge head mounted on a sterile rubber sponge mounting sleeve.

FIGS. 1, 2 and 4 show one embodiment of the oral wash brush 10. The oral wash brush 10 comprises a rigid handle 20, which includes a hand-hold portion 21, a first angled portion 22, a second angled portion 23, and a sponge attachment portion 24. Not all embodiments include the second angled portion 23 as some embodiments leave the sponge attachment section 24 at an angle to hand-hold portion 21. A sterile sponge head 30 is attached to the sponge attachment portion 24, usually through a fastening means utilizing several substantially cylindrical holes 25.

The sponge attachment portion 24 may accept several types of sterile sponge heads 30. The sponge attachment portion 24 is joined to the sterile sponge head 30 through one of several different types of fastening means. The sponge attachment section typically, but not always, contains several substantially cylindrical holes 25 to facilitate the fastening means. As shown in FIG. 1, the sterile sponge 30 is formed around the sponge attachment portion 24 where material of the sterile sponge 30 passes through the several substantially cylindrical holes 25 of the sponge attachment portion 24. This method forms a sterile sponge head that is integrated to the handle. When the life of the sterile sponge 30 is exhausted, the entire oral wash brush is disposed of.

This arrangement is even more clearly demonstrated in FIG. 2. FIG. 2 shows a cross section of the oral wash brush 10 taken along line 2—2 of FIG. 1. Portions of the sterile sponge 30 attach to the sponge attachment portion 24 by passing through the substantially cylindrical holes 25. The sterile sponge 30 is thus formed to become an integral part of the oral wash brush 10.

The sponge attachment portion is designed to accept various types of sterile sponge attachments. In one embodiment of the invention, the sterile sponge is formed directly onto the sponge attachment portion. This type of attachment provides a disposable oral wash brush. The sponge attachment portion is inserted into a sponge forming apparatus and the sponge is fitted to the handle. When the sponge attachment portion contains several substantially cylindrical holes, the sponge forming apparatus fills the several substantially cylindrical holes with sterile sponge material, forming a sterile sponge that is an integrated part of the oral wash brush. In this manner, the one piece sterile sponge forms three columns of sterile sponge material that pass through the several substantially cylindrical holes.

Figure 3:
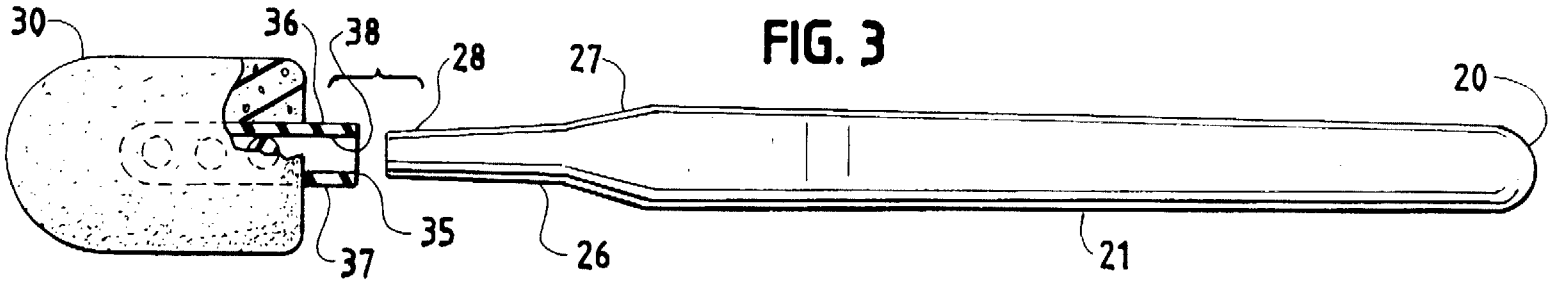
FIG. 3 is another embodiment of the oral wash brush, one having a detachable sterile sponge head.

FIG. 3 depicts another embodiment of the oral wash brush 10, one with a replaceable sterile sponge 30. In this embodiment, the oral wash brush 10 is comprised of a hand-hold portion 21, a handle mounting portion 26, a larger mounting end 27 and a smaller mounting end 28. The sterile sponge 30 is mounted to a sponge mounting portion 35 through any suitable fastening means. The sponge mounting portion 35 includes a tubular section 36, the tubular section having an outside diameter 37 and an inside diameter 38. The inside diameter 38 of the tubular section 36 is slightly larger than the smaller mounting end 28 of the handle mounting portion 26, but slightly smaller than the larger mounting end 27 of the handle mounting portion 26. The smaller mounting end 28 of the handle mounting portion 26 is inserted into the tubular section 36 of the sponge mounting portion 35. The two pieces remain together through friction between the handle mounting portion 26 and the tubular section 36 of the sponge mounting portion 35.

FIG. 5 depicts an embodiment of the rigid handle 20 which includes a hand-hold portion 21, a first angled portion 22, a sponge attachment portion 24, and several substantially cylindrical holes 25. This embodiment of the rigid handle, having only a first angled portion 22, but no second angled portion, allows an oral wash brush where the sponge head remains at an angle to the hand-hold portion 21 of the rigid handle 20. Any one of several different types of fastening means may attach the rigid handle 20 sponge head 30.

FIG. 6 depicts another embodiment of the invention, also having a disposable sterile sponge. This embodiment of the oral wash brush is comprised of a rigid handle 20, the rigid handle 20 comprising a hand-hold portion 21, a sponge attachment portion 24, the sponge attachment portion containing several substantially cylindrical holes 25, a sterile sponge head 30, and a sterile rubber sponge mounting sleeve 40. The sterile rubber mounting sleeve 40 is comprised of an inside diameter 42 molded in the shape of the sponge attachment portion 24 with an opening at one end 43 and several rubber extrusions 41. The rigid handle 20 may or may not contain angled portions, but FIG. 6 shows both a first angled portion 22 and a second angled portion 23.

The several rubber extrusions 41 include an inclined surface, formed so that the sterile sponge 30 can be easily installed onto the rigid handle 20, but not easily removed. When the several rubber extrusions 41 align with the several substantially cylindrical holes 25, the several rubber extrusions 41 fit into the several cylindrical holes 25. The inclined surface 44 allows longitudinal motion of the sterile rubber sponge mounting sleeve 40 down the rigid handle 20. Once the several rubber extrusions 41 mate with the several substantially cylindrical holes 25, the sterile rubber sponge mounting sleeve cannot move longitudinally up the rigid handle 20. When the life of the sterile sponge head 30 is exhausted, it is removed through the application of force sufficient to overcome the effectiveness of the inclined surface 44.

The invention is used in the following manner. First, the sponge is rinsed with tap water. The oral wash brush can be used with toothpaste as a substitute for a toothbrush, but is better used as an aid to a toothbrush. With thorough rinsing in between applications, it may be used with toothpaste and then with mouth wash. Second, the user applies toothpaste or mouthwash to the sterile sponge. Third, the user scrubs the entire mouth, including the teeth, gums, tongue, roof of the mouth, under the tongue, and the lips. In this context, lips refers to the inside surface of the mouth between the teeth and cheeks. The oral wash brush will clean through the use of friction so that bacteria that causes bad breath is scrubbed away instead of being masked with a rinse or mouthwash. After using a standard toothbrush with toothpaste, or the oral wash brush with toothpaste, the user rinses it thoroughly and applies mouthwash, preferably antiseptic mouthwash, and scrubs the entire mouth.

Of course, a person who is skilled in the art will recognize many other embodiments and modifications in light of the teachings of this patent. Therefore, the invention is not limited to the exact construction and operation described, but any suitable modification is included within the claims below.

I claim:

1. An oral wash brush suitable for oral hygiene and cleaning the entire mouth through application of friction, the oral wash brush comprising:

a rigid handle having a hand-hold portion and a sponge attachment portion, said sponge attachment portion having several substantially cylindrical holes and outside dimensions;

a sterile rubber sponge mounting sleeve having an inside diameter surface, said inside diameter surface having inside dimensions that are substantially the same as the outside dimensions of the sponge attachment portion, an opening at one end, and rubber extrusions having inclined surfaces at ends opposite the inside diameter surface;

a sterile sponge head useful for scrubbing the human mouth mounted to the sterile rubber mounting sleeve; and a fastening means wherein the sterile sponge head and sterile rubber sponge mounting sleeve are pushed onto the sponge attachment portion of the rigid handle, the inclined surfaces of the rubber extrusions allows movement of the sterile rubber sponge mounting sleeve until the rubber extrusions line up with and enter the several substantially cylindrical holes, preventing further linear motion with respect to the rigid handle until a great deal of force is used to remove the sterile rubber sponge mounting sleeve.

* * * * *